US007335878B2

(12) United States Patent
Beene et al.

(10) Patent No.: US 7,335,878 B2
(45) Date of Patent: Feb. 26, 2008

(54) METHOD AND APPARATUS FOR EFFICIENT PHOTODETACHMENT AND PURIFICATION OF NEGATIVE ION BEAMS

(75) Inventors: James R. Beene, Oak Ridge, TN (US); Yuan Liu, Knoxville, TN (US); Charles C. Havener, Knoxville, TN (US)

(73) Assignee: UT-Battelle LLC, Oak Ridge, TN (US)

( * ) Notice: Subject to any disclaimer, the term of this patent is extended or adjusted under 35 U.S.C. 154(b) by 299 days.

(21) Appl. No.: 11/251,710

(22) Filed: Oct. 17, 2005

(65) Prior Publication Data

US 2007/0085001 A1 Apr. 19, 2007

(51) Int. Cl.
*H01J 49/42* (2006.01)

(52) U.S. Cl. ..... 250/292; 250/423 P; 250/396 R

(58) Field of Classification Search ..... 250/292, 250/423 P, 396 R

See application file for complete search history.

(56) References Cited

U.S. PATENT DOCUMENTS 5,783,823 A * 7/1998 Mous et al. ..... 250/281
2006/0113464 A1* 6/2006 Litherland et al. ..... 250/288

OTHER PUBLICATIONS

D. Berkovits, et al., Nucl. Instr. And Meth. A281 (1989) 663-666.
D. Berkovits, et al., Nucl. Instr. And Meth. B52 (1990) 378-383.
"Collisional cooling of negative-ion beams," Y. Liu, J.F. Liang, G.D. Alton, J.R. Beene, Z. Zhou, H. Wollnik, Nuclear Instruments and Method in Physics Research, B 187 (2002) pp. 117-131.
"Isobar Suppression by Photodetachment in a RF Quadrupole Ion Cooler," Liu, Yuan; Havener, A.C.; Havener, C.C.; Liang, F.; Beene, J.R., The 71st Annual Meeting of the Southeastern Section of the American Physical Society (SESAPS), Nov. 11-13, 2004, Oak Ridge, Tennessee, Meeting ID: SES04, abstract #GD.024, published Nov. 2004.

* cited by examiner

*Primary Examiner*—Jack I. Berman
*Assistant Examiner*—Michael J Logie
(74) *Attorney, Agent, or Firm*—John Bruckner PC

(57) ABSTRACT

Methods and apparatus are described for efficient photodetachment and purification of negative ion beams. A method of purifying an ion beam includes: inputting the ion beam into a gas-filled multipole ion guide, the ion beam including a plurality of ions; increasing a laser-ion interaction time by collisional cooling the plurality of ions using the gas-filled multipole ion guide, the plurality of ions including at least one contaminant; and suppressing the at least one contaminant by selectively removing the at least one contaminant from the ion beam by electron photodetaching at least a portion of the at least one contaminant using a laser beam.

26 Claims, 9 Drawing Sheets

Prior Art

METHOD AND APPARATUS FOR EFFICIENT PHOTODETACHMENT AND PURIFICATION OF NEGATIVE ION BEAMS

STATEMENT AS TO RIGHTS TO INVENTIONS MADE UNDER FEDERALLY-SPONSORED RESEARCH OR DEVELOPMENT

This invention was made with United States Government support under prime contract No. DE-AC05-00OR22725 to UT-Battelle, L.L.C. awarded by the Department of Energy. The Government has certain rights in this invention.

BACKGROUND INFORMATION

1. Field of the Invention

Embodiments of the invention relate generally to the field of photodetachment and purification of ion beams. More particularly, embodiments of the invention relate to methods and apparatus for efficient electron photodetachment and purification of negative ion beams.

2. Discussion of the Related Art

The Holifield Radioactive Ion Beam Facility (HRIBF) at the Oak Ridge National Laboratory is an isotope separator on-line (ISOL) facility providing high-quality radioactive ion beams (RIBs) for research in nuclear structure and nuclear astrophysics. At the Holifield Radioactive Ion Beam Facility (HRIBF), short-lived radioactive atoms are produced in selected target materials by nuclear reactions, ionized and mass-separated in a two stage magnetic separator before being injected into a 25 MV tandem electrostatic accelerator where the beam energies needed for research are obtained. The radioactive ion beams (RIBs) are used to study nuclear reactions of fundamental importance to research in nuclear astrophysics and nuclear structure. High beam intensity and purity are of crucial importance to many experiments. Unfortunately, there are many cases in which isobaric contaminants in the beam cannot be removed effectively by the magnetic separators. Significant yields of contaminant species compromise many experiments. Consequently, development of effective and efficient beam purification techniques has become a major focus at the Holifield Radioactive Ion Beam Facility (HRIBF) as well as other radioactive ion beam (RIB) facilities.

Tandem accelerators require negatively charged ions as input. There are a number of adjacent-Z species whose electron affinities are such that photodetachment can be used to suppress the unwanted negative ion species while leaving the species of interest intact. Examples of particular interest include suppressing the $^{56}Co^-$ component in a mixed $^{56}Ni^-$+$^{56}Co^-$ beam and the $^{17}O^-$ component in a mixed $^{17}O^-$+$^{17}F^-$ radioactive ion beams. Selectively removing the unwanted negative ion species by laser-induced photodetachment has been suggested for applications in accelerator mass spectrometry [1,2]. Selectively removing the unwanted negative ion species by laser-induced photodetachment has also been suggested for applications in isotope separator on-line radioactive ion beam production [3].

D. Berkovits, et al. [1,2] used a pulsed Nd:YAG laser of 10 ns pulse width and 30 Hz pulse repetition rate to selectively neutralize S and Co negative ions, while leaving the Cl and Ni negative ions unaffected. In their experiment, the negative ions were traveling with ~100 keV energies, interacting with the laser beam over a distance of about 1.2 m. The overall degree of isobar suppression reported by D. Berkovits, et al. [1,2] was far from practically useful due to very short interaction time (a few micro seconds) between the pulsed laser beam and fast moving negative ion beams.

Meanwhile, gas-filled radio frequency (RF) quadrupole ion guides have been used extensively for ion beam cooling and bunching [4]. A RF quadrupole ion guide is a device in which ions with a selected mass/charge ratio are made to describe a stable path under the influence of a high frequency electrical field and are guided to pass through the device. When a buffer gas is introduced into the device, ions lose energy in collisions with the buffer gas molecules. With sufficient buffer gas pressure inside the ion guide, ion energy in both longitudinal and transverse directions can be reduced to the thermal energy of the buffer gas and the ion trajectories can be confined to a small region near the longitudinal axis of the device. Once cooled, the ions move at low velocity through the RF quadrupole under the influence of a modest longitudinal electrostatic field gradient.

Referring to FIG. 1, a Monte Carlo code has been used to simulate ion motions through gas-filled RF quadrupole ion guides [4]. FIG. 1 displays the calculated trajectories of negatively charged fluorine ions during transit through a 10 cm long RF quadrupole ion guide filled with helium at a gas pressure of 1.33 Pa. The negative ions enter the RF quadrupole with an initial energy of 40 eV. As noted, collisional cooling and focusing effects are clearly observed in the Monte Carlo simulations.

Heretofore, the requirement(s) of effective and efficient beam purification techniques referred to above have not been fully met. What is needed is a solution that simultaneously provides both effective and efficient beam purification.

SUMMARY OF THE INVENTION

There is a need for the following embodiments of the invention. Of course, the invention is not limited to these embodiments.

According to an embodiment of the invention, a process comprises purifying an ion beam including: inputting the ion beam into a gas-filled multipole ion guide, the ion beam including a plurality of ions; increasing a laser-ion interaction time by collisional cooling the plurality of ions using the gas-filled multipole ion guide, the plurality of ions including at least one contaminant; and suppressing the at least one contaminant by selectively removing the at least one contaminant from the ion beam by electron photodetaching at least a portion of the at least one contaminant using a laser beam. According to another embodiment of the invention, a machine comprising an ion beam purifier includes: a multipole ion guide having an upstream end and a downstream end; a source of ions operatively coupled to the upstream end of the multipole ion guide; a source of buffer gas connected to the multipole ion guide; and a laser optically coupled to the downstream end of the multipole ion guide, wherein a beam from the laser is coincident with an ion beam from the source of ions.

These, and other, embodiments of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of an embodiment of the invention without departing from the spirit thereof, and embodiments of the invention include all such substitutions, modifications, additions and/or rearrangements.

BRIEF DESCRIPTION OF THE DRAWINGS

The drawings accompanying and forming part of this specification are included to depict certain embodiments of the invention. A clearer conception of embodiments of the invention, and of the components combinable with, and operation of systems provided with, embodiments of the invention, will become more readily apparent by referring to the exemplary, and therefore nonlimiting, embodiments illustrated in the drawings, wherein identical reference numerals (if they occur in more than one view) designate the same elements. Embodiments of the invention may be better understood by reference to one or more of these drawings in combination with the description presented herein. It should be noted that the features illustrated in the drawings are not necessarily drawn to scale.

DESCRIPTION OF PREFERRED EMBODIMENTS

Figure 1:
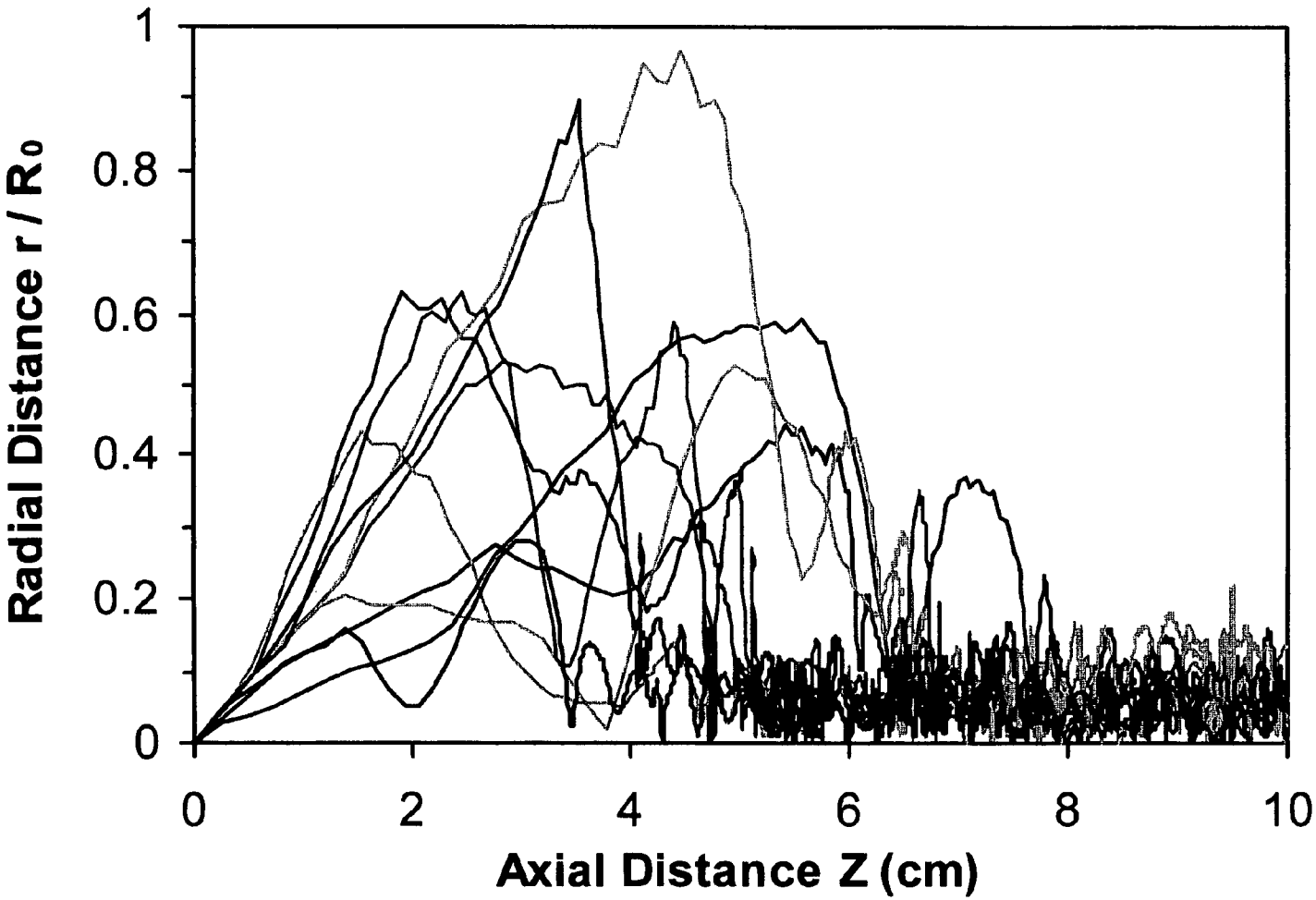
FIG. 1 depicts calculated trajectories of negatively charged fluorine ions during transit through an RF quadrupole ion guide filled with helium, appropriately labeled "prior art."

Embodiments of the invention and the various features and advantageous details thereof are explained more fully with reference to the nonlimiting embodiments that are illustrated in the accompanying drawings and detailed in the following description. Descriptions of well known starting materials, processing techniques, components and equipment are omitted so as not to unnecessarily obscure the embodiments of the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

Within this application several publications are referenced by Arabic numerals within brackets. Full citations for these, and other, publications may be found at the end of the specification immediately preceding the claims after the section heading References. The disclosures of all these publications in their entireties are hereby expressly incorporated by reference herein for the purpose of indicating the background of embodiments of the invention and illustrating the state of the art.

The invention can include methods of and apparatus for purifying ion beams. Embodiments of the invention can include photodetaching ions in a multipole ion guide containing buffer gas. The ions can be substantially isobaric or substantially non-isobaric. The ions can be negative or positive. The ions can be atomic or molecular.

A preferred embodiment of the invention can include a method for substantially improving the efficiency of neutralizing negative ions by photodetachment. The method can include slowing, cooling and/or storing negative ions in a gas-filled radio frequency only quadrupole ion guide device. Optical radiation is then introduced into the device to neutralize the negative ions by photodetachment. The method can further include incorporating the ion cooling device in purifying negative ion beams, where selected negative ions are neutralized by photons of proper energies, while leaving the other negative ions less affected or unaffected.

Because of the small photoionization cross sections ($\sim 10^{-17}$ $cm^2$) of negative ions, one needs either a large photon flux or a long laser-ion interaction time in order to obtain high photodetachment efficiency and thus a high degree of isobar suppression. The invention can increase the efficiency of photodetachment by photodetaching negative ions in a gas-filled RF quadrupole ion guide. The addition of a RF quadrupole ion guide to cool the negative ion beams can dramatically increase the interaction time of the ions with the laser and thus substantially increases the efficiency of the photodetachment process. Ion residence time in a 40 cm long RF quadrupole ion guide can be on the order of milliseconds. Such long laser-ion interaction time makes it possible to achieve near 100% efficiency of photodetachment with commercially available continuous wave (CW) lasers.

The combination of small transverse dimension and small longitudinal velocity of the ion beam results in a much longer interaction time and a much improved spatial overlap (coincidence) between the laser beam and the ions. Consequently, the efficiency of photodetachment can be greatly enhanced.

Calculations show that ion residence time in a 40 cm long RF quadrupole ion guide can be on the order of milliseconds. Such long laser-ion interaction times makes it possible to achieve high efficiency photodetachment with modest power CW lasers.

Alternative embodiments of the invention can include the use of pulsed lasers in combination with the longer ion residence times provided by the multipole collisional cooling. Embodiments of the invention can even include both CW laser(s) and pulsed laser(s). Pulsed lasers in general have much higher output power than CW lasers, which would compensate for less interaction time with the ions.

Alternative embodiment of the invention can include multiple RF multipole ion guides. For instance, embodiments of the invention can include a plurality of RF only quadrupole ion guides in series.

Figure 3:
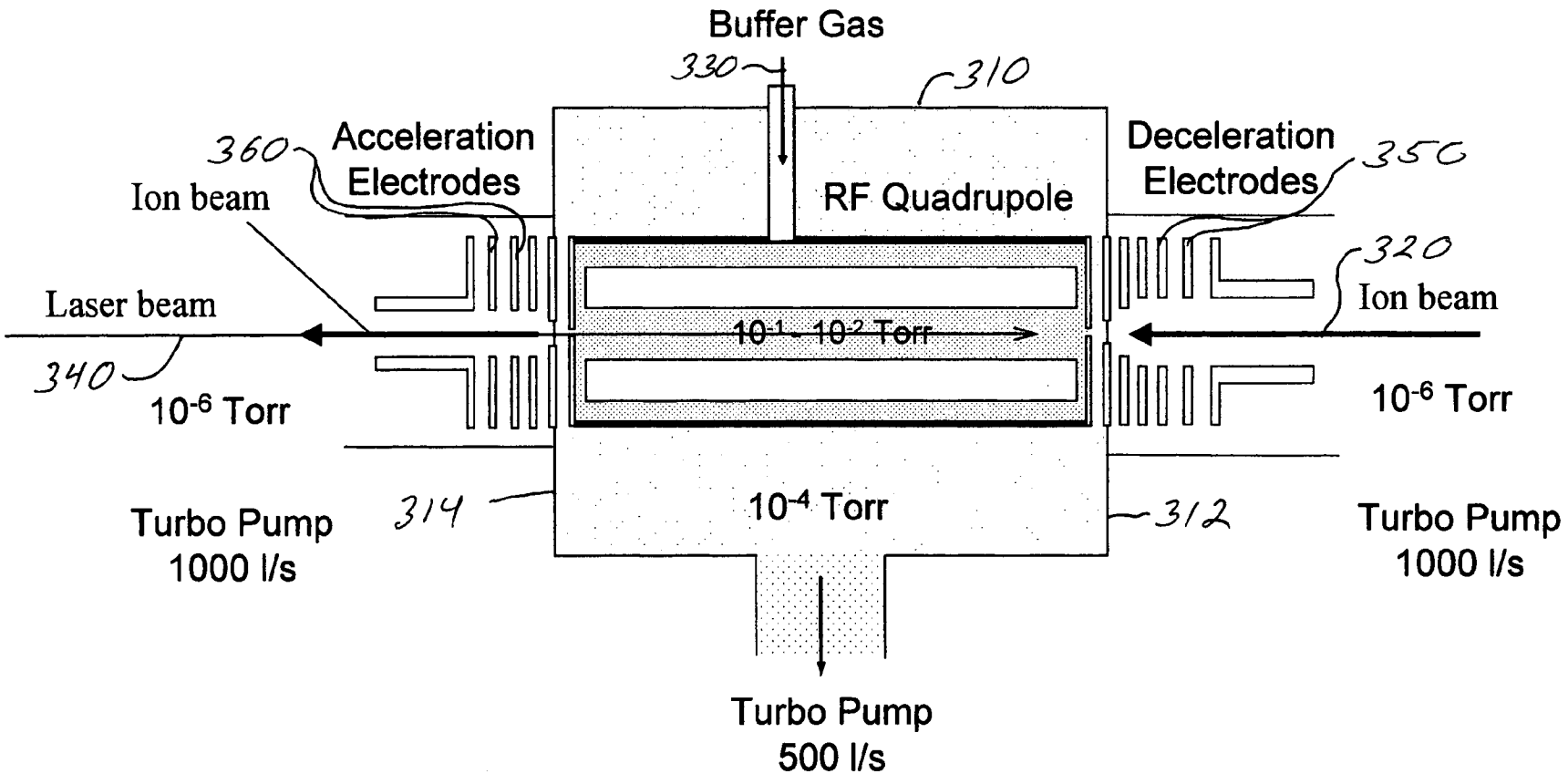
FIG. 3 is a schematic view of a gas-filled RF quadrupole with deceleration and acceleration electrodes, representing an embodiment of the invention.

FIG. 3 shows a high level schematic view of an apparatus embodiment of the invention. This embodiment is an ion beam purifier including a radio frequency quadrupole 310 having an upstream end 312 and a downstream end 314. A source of substantially isobaric ions (not shown in FIG. 3) is operatively coupled to the upstream end 312 of the quadrupole 310 and provide ion beam 320. A source of buffer gas (not shown in FIG. 3) is connected to the quadruple 310 and provides buffer gas 330. A laser (not shown in FIG. 3) is optically coupled to the downstream end 314 of the quadrupole and provide a laser beam 340. The laser beam 340 from the laser is coincident with an ion beam 320 from the source of substantially isobaric ions.

A set of electrodes 350 for decelerating and focusing the ion beam is coupled to the upstream end 312 of the quadrupole 310. A set of electrodes 360 for extracting and accelerating the ion beam is coupled to the downstream end 314 of the quadrupole 310.

The ion beam 320 is shown already introduced from the right hand side of the drawing propagating toward the left hand side of the drawing. The laser beam 340 is shown already introduced from the left hand side of the drawing propagating toward the right hand side of the drawing.

A critical feature of the concept is the use of a buffer gas filled radio frequency multipole ion guide to dramatically reduce the longitudinal ion velocity and to confine the beam to a small region near the longitudinal axis. These features make it possible to obtain essentially 100% spatial overlap between the ion and laser beams, and to greatly increase the interaction time between ions and the laser field. The ion guide makes it possible to obtain high photodetachment efficiency for a wide range of properties (phase space characteristics) of the initial ion beam.

The particular implementation of gas filled radio frequency multipole ion guide employed in demonstrations was a radiofrequency quadrupole (RFQ) but higher multipoles (such as a sextupole or octupole ion guide) may be used.

The laser beam can be introduced into the multipole ion guide device such that the laser beam path in the ion guide is coincident (coaxial) with the ion beam. The laser beam can propagate in the same or opposite direction of the ion beam.

FIGS. 4-7 illustrate several preferred embodiments with bending magnets, electrostatic deflecting electrodes, or the combination of magnetic and electrostatic deflection. The ion beam can be merged with and separated from the laser beam by electrostatic and magnetic fields.

Figure 4:
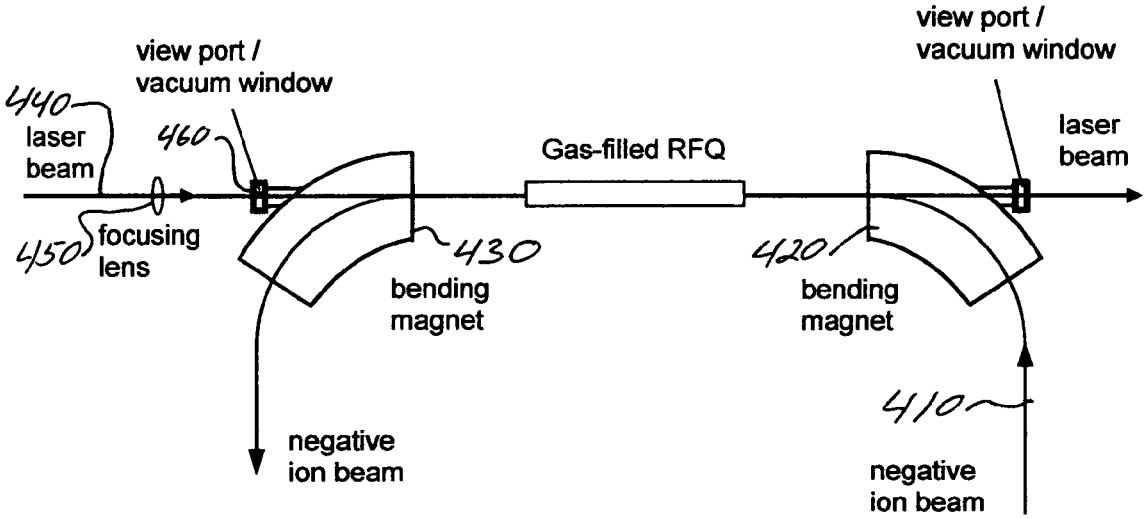
FIG. 4 is a schematic view of a gas-filled RF quadrupole with a first bending magnet and a second bending magnet, representing an embodiment of the invention.
Figure 5:
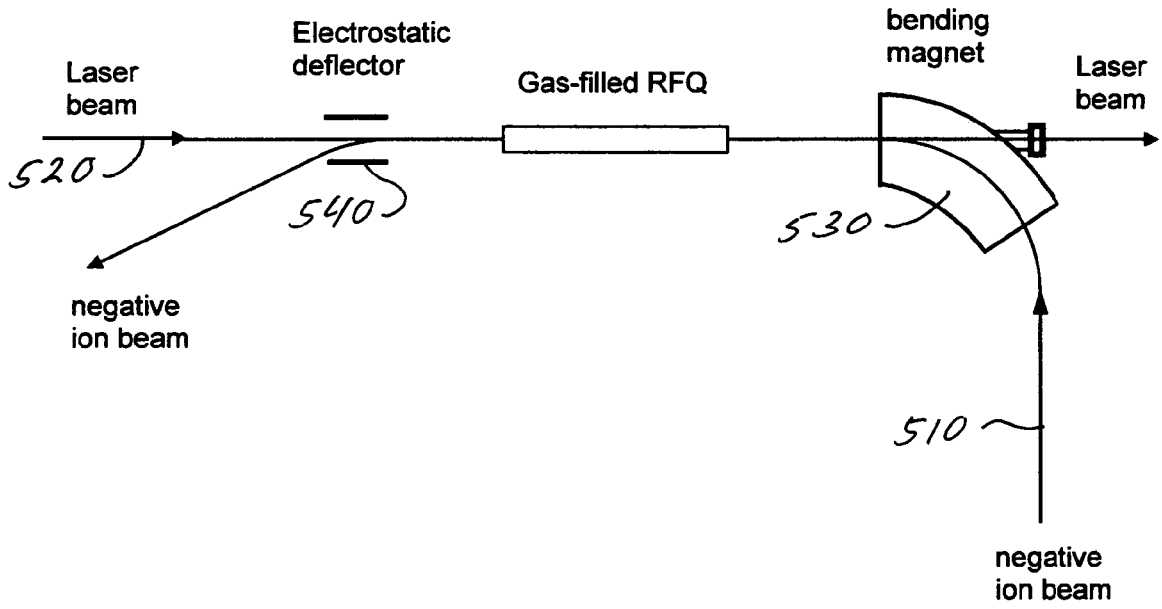
FIG. 5 is a schematic view of a gas-filled RF quadrupole with a bending magnet and an electrostatic deflector, representing an embodiment of the invention.

Referring to FIG. 4, ion beam 410 is merged with and separated from laser beam using bending magnets 420, 430. A laser beam 440 is introduced from the left propagating toward the right hand side of the drawing through a focusing lens 450 and then a view port 460 (vacuum window). A laser beam can also be introduced from right propagating toward the left hand side of the drawing as an alternative or addition.

Although a focusing lens is depicted and described as the structure for introducing the laser beam into the ion beam path, embodiment of the invention can utilize additional and/or other structures to perform this function. Embodiments of the invention can introduce the laser beam(s) into the ion path using mirrors, lenses, collimating optics, beam splitters, optical waveguides and/or combine multiple laser beams Referring to FIG. 5, an ion beam 510 is merged with and separated from a laser beam 520 using a bending magnet 530 and a parallel-plates electrostatic deflector 540. The laser beam 520 is introduced from the left propagating toward the right hand side of the drawing. Again, a laser beam can also be introduced from right propagating toward the left hand side of the drawing.

Figure 6:
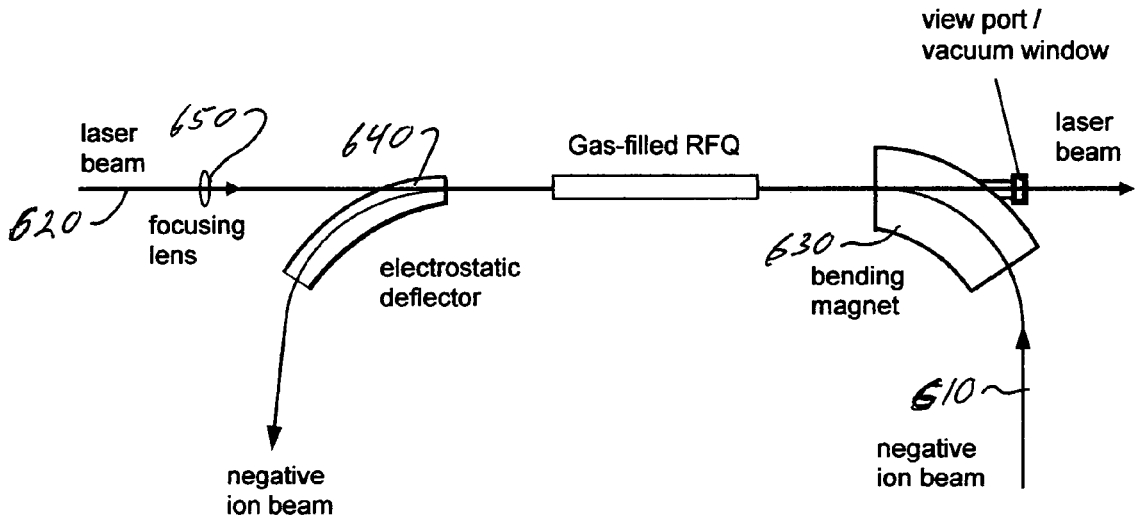
FIG. 6 is a schematic view of a gas-filled RF quadrupole with a laser beam focusing lens, an electrostatic deflector and a bending magnet, representing an embodiment of the invention.

Referring to FIG. 6, an ion beam 610 is merged with and separated from a laser beam 620 using a bending magnet 630 and a cylindrical electrostatic deflector 640. The laser beam 620 is introduced from the left propagating toward the right hand side of the drawing through a focusing lens 650. As above, a laser beam can also be introduced from right propagating toward the left hand side of the drawing.

Figure 7:
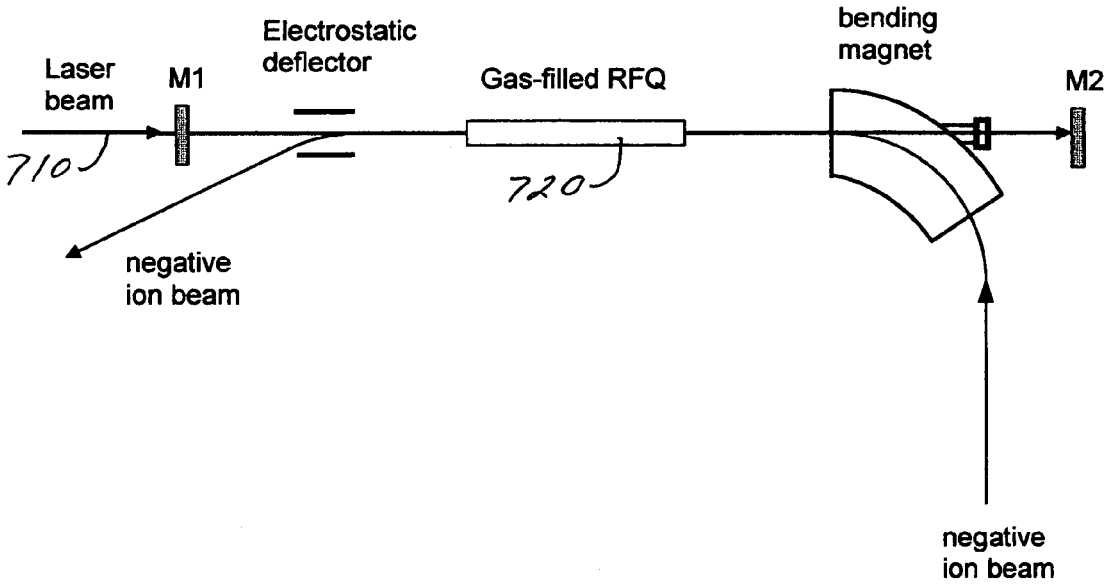
FIG. 7 is a schematic view of a gas-filled RF quadrupole with a first optical mirror, an electrostatic deflector, a bending magnet and a second optical mirror, representing an embodiment of the invention.

Referring to FIG. 7, optical mirrors M1, M2 may be used to obtain multiple passes of the laser beam 710 into and/or within the ion guide 720. It is important to appreciate that multiple reflections of laser beam may be incorporated between M1 and M2.

In general, the laser beam should be collimated and focused into the multipole ion guide. Readily commercially available optical components can be used. It is advantageous that the laser beam be well collimated, aligned, and focused to an appropriate beam size for optimal injection into the multipole ion guide and optimal overlapping between the photons and ions inside the ion guide.

Alternatively, the laser beam may be introduced into the ion guide transversely (not coaxial with the ion beam), for example, with rectangular optical guides or an array of optical fibers. Linear diode laser arrays may be incorporated to provide laser radiation along the ion guide in a transverse direction.

Ion beams with a wide range of energies (e.g., from approximately a few eV to approximately >100 keV) can be used with the device. In general, the ions beams should be collimated and focused into the multipole ion guide by electric and magnetic fields. High energy negative ions need to be decelerated to low energies (for example, <40 eV) before injection into the multipole ion guide, in order to reduce the probability of electron detachment due to collisions with buffer gas molecules because the collisional detachment process is not selective. For low energy ion beams (e.g, <40 eV) deceleration is not needed.

The buffer gas can be H, He, $N_2$, Ne, Ar, etc. It is preferred that the mass of the buffer gas used is smaller than the mass of the ions so that collisional cooling is effective and the probability of collisional detachment is small.

More than one laser beam of the same or different wavelengths may be used. Electrons may be detached by one-photon and one-color, multi-photon and one-color or multi-photon and multi-color processes.

Photodetachment process occurs in accordance with the scheme $$A^- + h\nu \rightarrow A + e^-$$

where one valence electron in the negative ion $A^-$ is detached by absorption of a photon of frequency ν. The photon energy hν must equal or exceed the electron affinity (EA) of the negative ion in order for photodetachment to occur.

$$h\nu \geq EA \quad (1)$$

For selective photodetachment, the frequency of the photon should be chosen as $$EA_1 \leq h\nu \leq EA_2 \quad (2)$$

where $EA_1$ is the electron affinity of the negative ion to be neutralized, and $EA_2$ is the electron affinity of the negative ion that should not be neutralized.

The photodetachment efficiency $\epsilon$ is determined by the Beer's law $$\epsilon=1-\exp(-\sigma\phi t) \quad (3)$$

where $\sigma$ ($cm^2$) is the photodetachment cross section, $\phi$ (photons $cm^{-2}s^{-1}$) is the photon flux, and t (s) is the interaction time.

In terms of laser beam power P (W), laser beam cross section A ($cm^2$), and laser wavelength $\lambda$ (nm), the product of $\sigma\phi t$ can be written as $$\sigma\phi t=5.0343\times10^{15}\sigma t\, P\lambda/A \quad (4)$$

The larger this product is, the higher the photodetachment efficiency.

Figure 8:
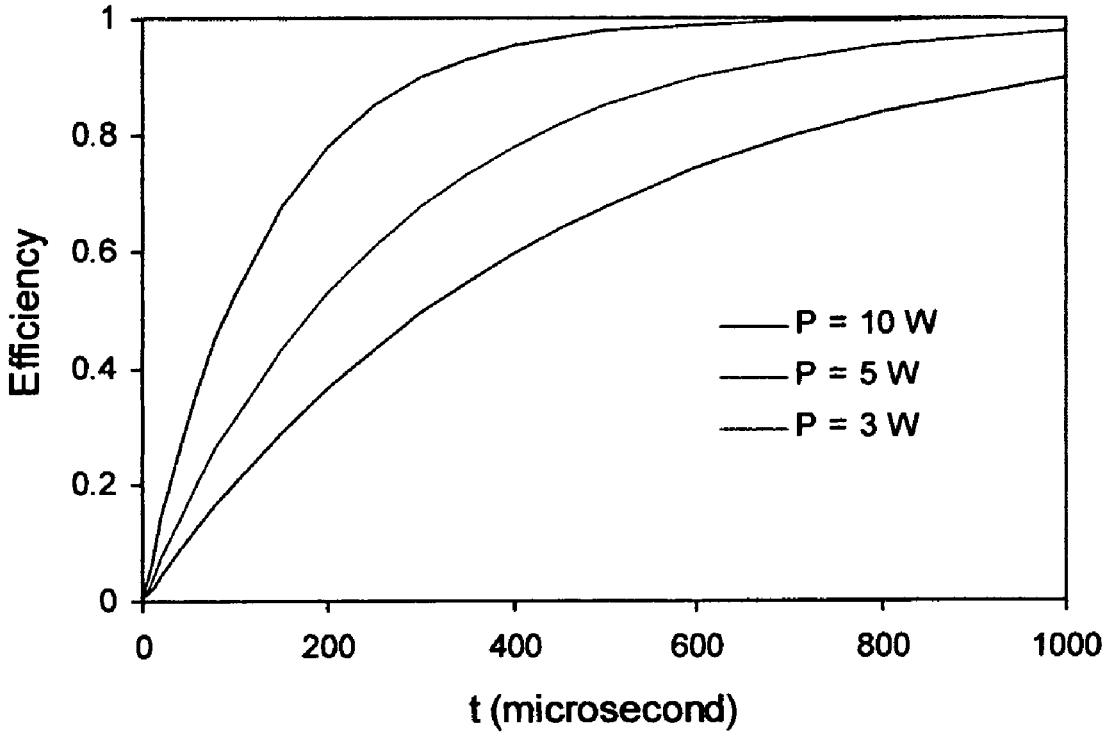
FIG. 8 is a time domain trace of photodetachment efficiency for three different laser power levels, representing an embodiment of the invention.

Photodetachment cross section is typically on the order of $10^{-17}$ ($cm^2$). Using this value for $\sigma$ and assuming a laser beam of diameter 3 mm and wavelength $\lambda$=1064 nm, also assuming perfect overlap between the laser and ion beam, one has $$\sigma\phi t=757.8P\, t \quad (5)$$

where P is the laser beam power in Watt and t is the laser-ion interaction time in seconds. The calculated photodetachment efficiency using equation 3 and equation 5 is plotted in FIG. 8 as a function of the laser-ion interaction time for laser power P=3 W, 5 W and 10 W. As noted, it is possible to achieve near 100% photodetachment efficiency, and thus 100% purification, with commercially available lasers if an interaction time on the order of 1 ms can be obtained. A gas-filled multipole ion guide is a device that can slow down and retain the negative ions, thus significantly increasing the laser-ion interaction time.

The efficiency of purification depends on the laser wavelength or frequency. Referring to equation 2, $h\nu$ should be larger then the EA of the negative ions to be removed, so that the photodetachment cross section is large. In general, the larger the value of $h\nu-EA_1$ is, the higher the detachment efficiency. At the same time, $h\nu<EA_2$ is desired.

The efficiency of purification also depends on ionic species that satisfy equation 2. Examples of interest include:

- Co ($EA_1$=0.661 eV), Ni ($EA_2$=1.156 eV): $\lambda$=1064 nm (1.165 eV)
- O ($EA_1$=1.4611 eV), F ($EA_2$=3.399 eV): $\lambda$=532 nm (2.33 eV)
- S ($EA_1$=2.0771 eV), Cl ($EA_2$=3.617 eV): $\lambda$=532 nm (2.33 eV)

Figure 9:
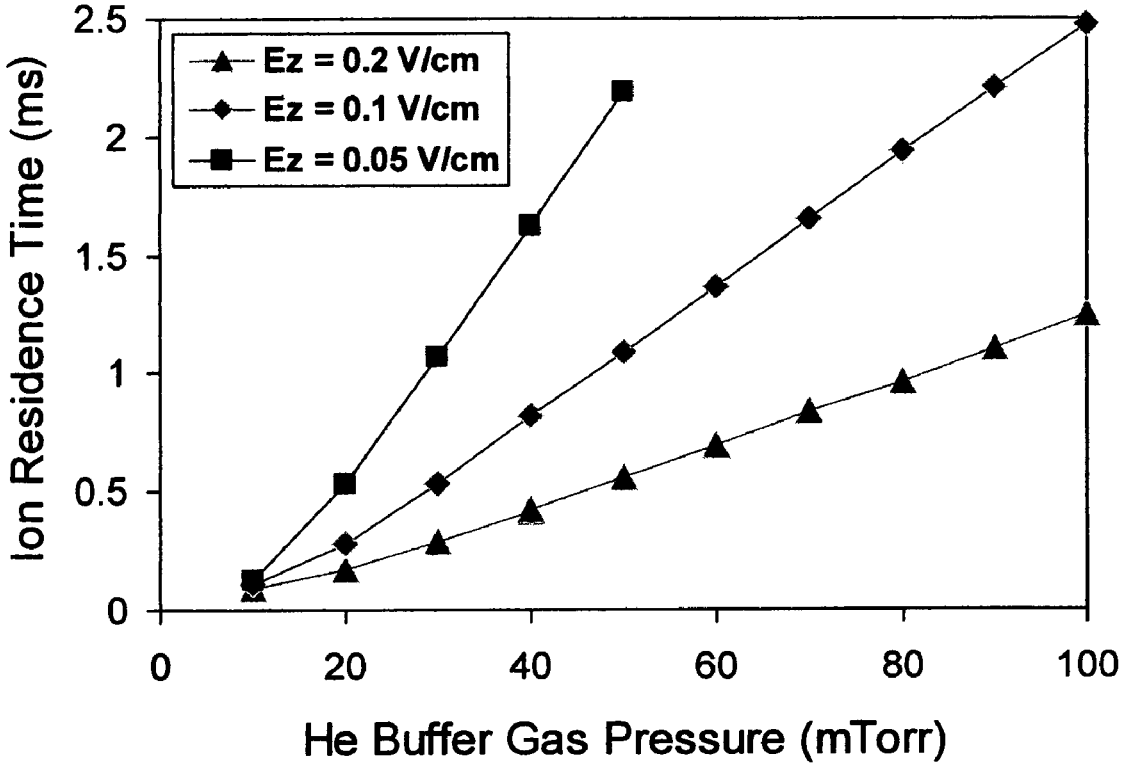
FIG. 9 is a pressure domain trace of ion residence time for three different longitudinal field levels, representing an embodiment of the invention.

The efficiency of purification also depends on the buffer gas pressure and the radiofrequency quadrupole operating parameters: The key benefit of using a gas-filled ion guide is the long laser-ion interaction time. Because of collisions with buffer gas molecules, the ions' translational energies can be reduced to the thermal energy of the buffer gas, and the ions then move at low velocities through the radiofrequency quadrupole under the influence of a small longitudinal electrostatic field gradient. The critical features of the ion guide which influence the photodetachment efficiency are reflected in the quantity t in equations 3, 4 and 5, and the spatial concentration and confinement of the ion beam near the longitudinal axis of the ion guide which allows us to assume (within acceptable accuracy) essentially perfect overlap with the laser beam in deriving equation 3. Unfortunately, these ion guide performance parameters can not be described by analytical mathematical expressions in terms of the buffer gas pressure and radiofrequency quadrupole operating parameters. However, Monte Carlo simulation code can accurately predict ion trajectories and calculate ion transit times and energies. FIG. 9. shows the calculated $^{56}Co^-$ transit time in a 40 cm long radiofrequency quadrupole device as a function of buffer gas pressure, for different longitudinal direct current (DC) field gradients. The calculated Co negative ion transit time is in a 40 cm long radiofrequency quadrupole. The radiofrequency quadrupole operation parameters are: $r_0$=3.5 mm, L=40 cm, f=2.75 MHz, $V_{rf}$=160 V, where $r_0$ is the radius of the inscribed circle between quadrupole electrodes, L is the quadrupole length, and f and $V_{rf}$ are the frequency and amplitude of the radiofrequency potential, respectively. Ion mass=56. Ion initial energy=17 eV.

As illustrated in FIG. 9, the higher the buffer gas pressure, the longer the laser-ion interaction time, and thus the higher the photodetachment and purification efficiency. However, if the buffer gas pressure is too high, transmission of the desired species of negative ions though the ion guide may decrease due to collisional detachment, or in the case of radioactive species through decay. Such losses are, of course, undesirable. Therefore, there is an optimal buffer gas pressure depending on the ion species, radiofrequency quadrupole dimensions and radio frequency (RF) electrical field.

Also seen in FIG. 9, the smaller the longitudinal field, the longer the laser-ion interaction time. However, as in the case of buffer gas pressure, an optimum value will generally exist below which unacceptable negative ion transmission losses occur. The DC longitudinal electric field may be created in several ways, including use of segmented quadrupole rod structure or tapered electrodes inserted between the quadrupole rods.

EXAMPLE

A specific embodiment of the invention will now be further described by the following, nonlimiting example which will serve to illustrate in some detail various features. The following example is included to facilitate an understanding of ways in which an embodiment of the invention may be practiced. It should be appreciated that the examples which follow represent an embodiment discovered to function well in the practice of the invention, and thus can be considered to constitute a preferred mode for the practice of the embodiments of the invention. However, it should be appreciated that many changes can be made in the exemplary embodiments which are disclosed while still obtaining like or similar result without departing from the spirit and scope of an embodiment of the invention. Accordingly, the example should not be construed as limiting the scope of the invention.

In a proof-of-concept experiment, this technique has been tested using stable $^{58}Ni$ and $^{59}Co$ negative ion beams and a continuous wave (CW) Nd:YAG laser beam at 1064 nm wavelength to selectively remove (neutralize/suppress) the $Co^-$ ions in a 40 cm long RF quadrupole ion guide filled with helium gas at a pressure of ~6 Pa. The energy of the 1064 nm photon is 1.165 eV, much larger than the electron affinity of cobalt (0.661 eV), but also slightly above the electron affinity of nickel (1.156 eV). Therefore, some neutralization of $Ni^-$ ions was expected. About 2.5 W laser radiation was injected into the RF quadrupole ion guide in the experiment.

It was discovered that 95% of Co negative ions were removed, while only 10% of Ni negative ions were neutralized, with ~2.5 W CW laser beam at 1064 nm wavelength.

Figure 2A:
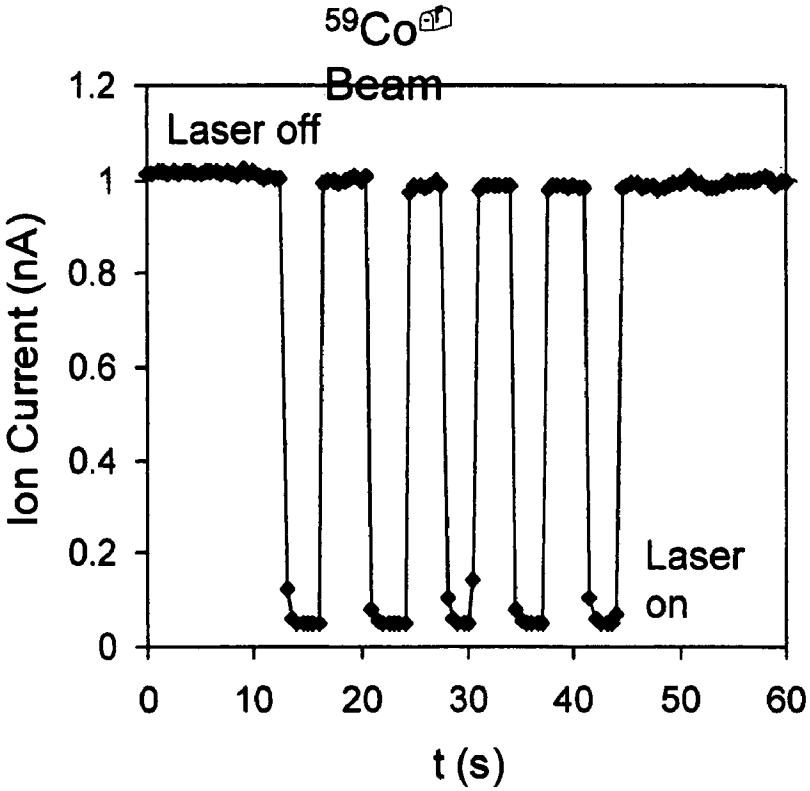
FIGS. 2A and 2B are time domain ion current traces of $^{59}Co^-$ (FIG. 2A) and $^{58}Ni^-$ (FIG. 2B) measured after an RF (radio frequency) quadrupole guide with laser beams modulated on and off, representing an embodiment of the invention.
Figure 2B:
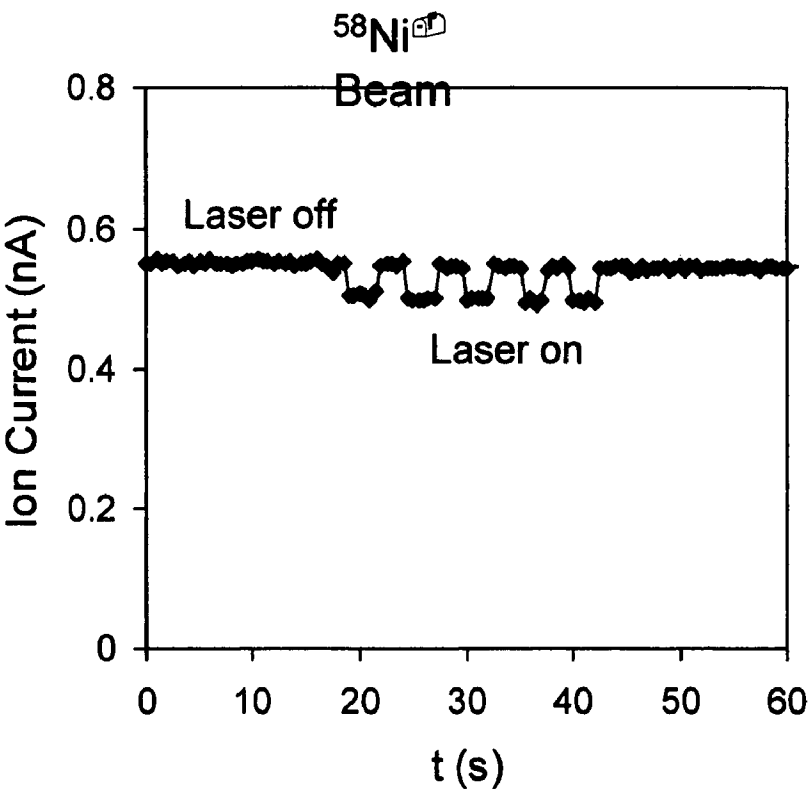

Referring to FIGS. 2A and 2B, the Co and Ni negative ion currents are shown as measured after the radiofrequency quadrupole ion guide with laser beams turned on and off. As shown, 95% of the $Co^-$ ions were removed, while only 10% of $Ni^-$ ions were neutralized. The detachment efficiency was limited by the laser power available in the experiment. Based on these results, it is expected that removal of >99% of the $Co^-$ ions can achieved with about 5 W CW laser beam which is available with existing commercial lasers.

Practical Applications

The invention can be used to enhance photodetachment efficiencies, purify ion beams, or generate neutral beams for scientific and industrial applications. Immediate applications in basic research include purifying isobaric contaminants in radioactive ion beams for nuclear research at the HRIBF or other accelerator facilities. Examples include: suppressing the $^{56}Co^-$ content of a radioactive mass 56 beam and/or removing the $^{17}O^-$ contaminant in a radioactive $^{17}F^-$ beam.

The invention should find great utility in enhancing the performance of accelerator mass spectrometry (AMS). Accelerator mass spectrometry is an ultra-sensitive technique that uses an ion accelerator, multi-stage mass and charge analysis, and ultimately individual ion counting for detection of long-lived radio nuclides such as $^{10}Be$, $^{14}C$, $^{26}Al$, $^{36}Cl$, $^{41}Ca$ and $^{129}I$ at isotopic ratios between $10^{-10}$ and $10^{-15}$. It is widely used in radiocarbon dating for applications in geological and planetary sciences, archaeology, etc., and is being increasingly used in non-dating applications in environmental, material, and biomedical sciences, nuclear safeguards, climate research, and many other basic and applied research topics and fields Typical accelerator mass spectrometry facilities require large ion accelerators and nuclear physics scale facilities for sufficient reduction of isobaric and molecular background. The detection limit of accelerator mass spectrometry is often determined by the ability of suppressing the interfering isobars. Substantial research effort has been focused on developing various techniques of isobar separation to explore the limits of accelerator mass spectrometry techniques and their application potential to a great variety of other radioisotopes ($^{32}Si$, $^{59}Ni$, $^{60}Fe$ and $^{126}Sn$). The invention offers a highly efficient technique to remove isobaric contaminants in the negative ion beams before acceleration. The technique is applicable to radioisotope negative ions whose electron affinities are higher than those of the interfering isobaric contaminants. Examples of particular interest include suppressing $^{36}S$ and $^{59}Co$ components for accelerator mass spectrometry detection of $^{36}Cl$ and $^{59}Ni$, respectively. The invention can improve the detection limit of accelerator mass spectrometry measurements of $^{36}Cl$ and $^{59}Ni$ by at least one order of magnitude. It could also make some accelerator mass spectrometry measurements that require large tandem accelerators feasible with smaller or even portable accelerators. Therefore, the invention can improve the performance, enhance the capability, and broaden applicability of the field of accelerator mass spectrometry techniques.

Advantages

Embodiments of the invention can be cost effective and advantageous for at least the following reasons. The invention can provide near 100% efficiency of photodetachment and, consequently, near 100% suppression of isobar contaminants in negative ion beams. Simulation studies and the actual proof-of-principle experimental results show that such high efficiency photodetachment can be obtained with modest power commercial CW lasers. Furthermore, this technique can be implemented in a setup compact enough to add to existing accelerator facilities. Therefore, it should be straightforward to adapt the technique to basic research and commercial applications, such as purifying isobaric contaminants in radioactive ion beams for research at the Holifield Radioactive Ion Beam Facility (HRIBF) and other research facilities, and removing unwanted stable and radioisotope isobars in radioisotope ion beams for accelerator mass spectrometry analyses. Embodiments of the invention improve quality and/or reduce costs compared to previous approaches.

Definitions

The phrase radio frequency is intended to mean frequencies less than or equal to approximately 300 GHz as well as the infrared spectrum. The term substantially is intended to mean largely but not necessarily wholly that which is specified. The term approximately is intended to mean at least close to a given value (e.g., within 10% of). The term generally is intended to mean at least approaching a given state. The term coupled is intended to mean connected, although not necessarily directly, and not necessarily mechanically. The term proximate, as used herein, is intended to mean close, near adjacent and/or coincident; and includes spatial situations where specified functions and/or results (if any) can be carried out and/or achieved. The term deploying is intended to mean designing, building, shipping, installing and/or operating.

The terms first or one, and the phrases at least a first or at least one, are intended to mean the singular or the plural unless it is clear from the intrinsic text of this document that it is meant otherwise. The terms second or another, and the phrases at least a second or at least another, are intended to mean the singular or the plural unless it is clear from the intrinsic text of this document that it is meant otherwise. Unless expressly stated to the contrary in the intrinsic text of this document, the term or is intended to mean an inclusive or and not an exclusive or. Specifically, a condition A or B is satisfied by any one of the following: A is true (or present) and B is false (or not present), A is false (or not present) and B is true (or present), and both A and B are true (or present). The terms a or an are employed for grammatical style and merely for convenience.

The term plurality is intended to mean two or more than two. The term any is intended to mean all applicable members of a set or at least a subset of all applicable members of the set. The phrase any integer derivable therein is intended to mean an integer between the corresponding numbers recited in the specification. The phrase any range derivable therein is intended to mean any range within such corresponding numbers. The term means, when followed by the term "for" is intended to mean hardware, firmware and/or software for achieving a result. The term step, when followed by the term "for" is intended to mean a (sub) method, (sub)process and/or (sub)routine for achieving the recited result.

The terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. The terms "consisting" (consists, consisted) and/or "composing" (composes, composed) are intended to mean closed language that does not leave the recited method, apparatus or composition to the inclusion of procedures, structure(s) and/or ingredient(s) other than those recited except for ancillaries, adjuncts and/or impurities ordinarily associated therewith. The recital of the term "essentially" along with the term "consisting" (consists, consisted) and/or "composing" (composes, composed), is intended to mean modified close language that leaves the recited method, apparatus and/or composition open only for the inclusion of unspecified procedure(s), structure(s) and/or ingredient(s) which do not materially affect the basic novel characteristics of the recited method, apparatus and/or composition.

Unless otherwise defined, all technical and scientific terms used herein have the same meaning as commonly understood by one of ordinary skill in the art to which this invention belongs. In case of conflict, the present specification, including definitions, will control.

CONCLUSION

The described embodiments and examples are illustrative only and not intended to be limiting. Although embodiments of the invention can be implemented separately, embodiments of the invention may be integrated into the system(s) with which they are associated. All the embodiments of the invention disclosed herein can be made and used without undue experimentation in light of the disclosure. Although the best mode of the invention contemplated by the inventor(s) is disclosed, embodiments of the invention are not limited thereto. Embodiments of the invention are not limited by theoretical statements (if any) recited herein. The individual steps of embodiments of the invention need not be performed in the disclosed manner, or combined in the disclosed sequences, but may be performed in any and all manner and/or combined in any and all sequences. The individual components of embodiments of the invention need not be formed in the disclosed shapes and/or combined in the disclosed configurations, but could be provided in any and all shapes and/or combined in any and all configurations.

It can be appreciated by those of ordinary skill in the art to which embodiments of the invention pertain that various substitutions, modifications, additions and/or rearrangements of the features of embodiments of the invention may be made without deviating from the spirit and/or scope of the underlying inventive concept. All the disclosed elements and features of each disclosed embodiment can be combined with, or substituted for, the disclosed elements and features of every other disclosed embodiment except where such elements or features are mutually exclusive. The spirit and/or scope of the underlying inventive concept as defined by the appended claims and their equivalents cover all such substitutions, modifications, additions and/or rearrangements.

The appended claims are not to be interpreted as including means-plus-function limitations, unless such a limitation is explicitly recited in a given claim using the phrase(s) "means for" and/or "step for." Subgeneric embodiments of the invention are delineated by the appended independent claims and their equivalents. Specific embodiments of the invention are differentiated by the appended dependent claims and their equivalents.

REFERENCES

1. D. Berkovits, et al., Nucl. Instr. And Meth. A281 (1989) 663-666.
2. D. Berkovits, et al., Nucl. Instr. And Meth. B52 (1990) 378-383.
3. G. D. Alton, private communication, 2003.
4. "Collisional cooling of negative-ion beams," Y. Liu, J. F. Liang, G. D. Alton, J. R. Beene, Z. Zhou, H. Wollnik, Nuclear Instruments and Method in Physics Research, B 187 (2002) pages 117-131.
5. "Isobar Suppression by Photodetachment in a RF Quadrupole Ion Cooler," Liu, Yuan; Havener, A. C.; Havener, C. C.; Liang, F.; Beene, J. R., The 71st Annual Meeting of the Southeastern Section of the American Physical Society (SESAPS), Nov. 11-13, 2004, Oak Ridge, Tenn., Meeting ID: SES04, abstract #GD.024, published November 2004.

What is claimed is:

1. A method, comprising purifying an ion beam including:

inputting the ion beam into a gas-filled multipole ion guide, the ion beam including a plurality of ions;

increasing a laser-ion interaction time by collisional cooling the plurality of ions using the gas-filled multipole ion guide, the plurality of ions including at least one contaminant; and suppressing the at least one contaminant by selectively removing the at least one contaminant from the ion beam by electron photodetaching at least a portion of the at least one contaminant using a laser beam.

2. The method of claim 1, wherein the plurality of ions includes a plurality of substantially isobaric ions and the at least one contaminant includes at least one isobar contaminant.

3. The method of claim 2, wherein the ion beam includes negative ions, the plurality of substantially isobaric ions includes a plurality of substantially isobaric negative ions and the at least one isobar contaminant includes at least one negative isobar contaminant.

4. The method of claim 2, wherein collision cooling the plurality of substantially isobaric negative ions using the gas-filled multipole ion guide includes using a gas-filled radio frequency only quadrupole ion guide.

5. The method of claim 2, wherein electron photodetaching at least a portion of the at least one isobar contaminant using the laser includes using a continuous wave laser.

6. The method of claim 2, wherein electron photodetaching at least a portion of the at least one isobar contaminant using the laser includes using a pulsed laser.

7. The method of claim 1, further comprising decelerating the ion beam.

8. The method of claim 1, further comprising accelerating the ion beam.

9. The method of claim 1, further comprising refracting the laser beam using a focusing lens.

10. The method of claim 1, further comprising reflecting the laser beam using both a first mirror and a second mirror to increase a laser-ion interaction probability.

11. The method of claim 1, further comprising bending the ion beam magnetically.

12. The method of claim 1, further comprising deflecting the ion beam electrostatically.

13. The method of claim 2, further comprising focusing the plurality of substantially isobaric ions using the gas-filled multipole ion guide to increase a laser-ion interaction probability.

14. A method, comprising purifying a negative ion beam including:

decelerating the negative ion beam;

inputting the negative ion beam into a gas-filled multipole ion guide, the ion beam including a plurality of substantially isobaric negative ions;

increasing a laser-ion interaction time by collisional cooling the plurality of substantially isobaric negative ions using the gas-filled multipole ion guide, the plurality of substantially isobaric ions including at least one negative isobar contaminant;

focusing the plurality of substantially isobaric ions using the gas-filled multipole ion guide to increase a laser-ion interaction probability;

suppressing the at least one negative isobar contaminant by selectively removing the at least one negative isobar contaminant from the negative ion beam by electron photodetaching at least a portion of the at least one negative isobar contaminant using a continuous wave laser beam; and accelerating the negative ion beam.

15. An apparatus, comprising an ion beam purifier including:

a multipole ion guide having an upstream end and a downstream end;

a source of ions operatively coupled to the upstream end of the multipole ion guide;

a source of buffer gas connected to the multipole ion guide; and a laser optically coupled to the downstream end of the multipole ion guide, wherein a beam from the laser is coincident with an ion beam from the source of ions.

16. The apparatus of claim 15, wherein the source of ions includes a source of substantially isobaric ions.

17. The apparatus of claim 16, wherein the source of substantially isobaric ions includes a source of substantially isobaric negative ions.

18. The apparatus of claim 15, wherein the multipole ion guide includes a gas-filled radio frequency only quadrupole ion guide.

19. The apparatus of claim 15, wherein the laser includes a continuous wave laser.

20. The apparatus of claim 15, wherein the laser includes a pulsed laser.

21. The apparatus of claim 15, further comprising a set of deceleration electrodes coupled to the upstream end of the multipole ion guide.

22. The apparatus of claim 15, further comprising a set of acceleration electrodes coupled to the downstream end of the multipole ion guide.

23. The apparatus of claim 15, further comprising a focusing lens optically coupled between the laser and the multipole ion guide.

24. The apparatus of claim 15, further comprising a first mirror optically coupled to the downstream end of the multipole ion guide and a second mirror optically coupled to the upstream end of the multipole ion guide.

25. The apparatus of claim 15, further comprising a bending magnet operatively coupled to the multipole ion guide.

26. The apparatus of claim 15, further comprising an electrostatic deflector operatively coupled to the multipole ion guide.

* * * * *